US005348276A

United States Patent [19]

Blacker

[11] Patent Number: 5,348,276

[45] Date of Patent: Sep. 20, 1994

[54] SLIDE BAR CLAMP AND STRAIGHT EDGE

[75] Inventor: Paul N. Blacker, Tewksbury, Mass.

[73] Assignee: Trend-Lines, Inc., Chelsea, Mass.

[21] Appl. No.: 40,556

[22] Filed: Mar. 31, 1993

[51] Int. Cl.[5] ..... B25B 1/10

[52] U.S. Cl. ..... 269/88; 269/167; 269/168; 269/169; 269/152

[58] Field of Search ..... 269/166–171.5, 269/88, 6, 188, 152, 43; 81/487

[56] References Cited

U.S. PATENT DOCUMENTS

| | | | |
|---|---|---|---|
| 511,429 | 12/1893 | Hubbell . | |
| 2,362,067 | 11/1944 | Heinrich . | |
| 2,424,313 | 7/1947 | Heinrich . | |
| 2,612,805 | 10/1952 | Heinrich . | |
| 2,735,323 | 2/1956 | Phillips . | |
| 2,846,907 | 8/1958 | Sprink . | |
| 3,107,909 | 10/1963 | Kuchenbecker | 269/171.5 |
| 3,815,894 | 6/1974 | Olson | 269/167 |
| 4,057,239 | 11/1977 | Hopf et al. . | |
| 4,257,584 | 3/1981 | Sterling | 269/167 |
| 4,394,800 | 7/1983 | Griset . | |
| 4,607,829 | 8/1986 | Suska | 269/152 |
| 4,926,722 | 5/1990 | Sorensen et al. . | |
| 4,989,847 | 2/1991 | Chapman . | |
| 5,094,131 | 3/1992 | Sorensen et al. . | |
| 5,161,787 | 11/1992 | Hobday . | |

*Primary Examiner*—Robert C. Watson
*Attorney, Agent, or Firm*—Bromberg & Sunstein

[57] ABSTRACT

A slide bar clamp having a straight surface on an elongated base that can serve as a straight edge. The base includes a longitudinal channel in which a rod is suspended. A first clamp surface is fixed at one end of the base. A moveable lock and clamp structure is mounted for longitudinal movement within the channel back and forth along the rod. The lock and clamp structure is formed in a housing. A handle is rotatably mounted on the housing. The handle locks by forcing an increasingly widened portion against a plurality of lock plates. The lock plates are arranged face-to-face and each has a hole through which the rod is inserted. In the locked position, the lock plates are tilted such that the inner edges of their holes grab the rod to prevent movement of the lock and clamp structure away from the fixed clamp surface. The slide bar clamp has a flat surface which permits mounting of the slide bar clamp on an adjacent flat surface or the back of an adjacent clamp. Thus, a double-sided clamp can be easily constructed.

18 Claims, 4 Drawing Sheets

SLIDE BAR CLAMP AND STRAIGHT EDGE

BACKGROUND OF THE INVENTION

The present invention is directed to a clamping mechanism that doubles as a straight edge.

Clamps, vises, and straight edges are commonly used hand tools. Vises and clamps are used to hold a work piece in place. While a workpiece is clamped, other operations may be performed on the piece, such as sawing, routing, or drilling. Also, clamps may be used to hold the workpieces together that have been glued to allow the adhesive to set. If an operation needs to be performed along a straight edge, a solid straight edge may be clamped at either end to a work piece. This generally involves the use of two clamps along with the straight edge.

SUMMARY OF THE INVENTION

The hand tool of the present invention advantageously performs several functions. It can be used as a mountable straight edge. It can be used as a simple bar clamp. The invention may further be used by mounting two of the clamps back-to-back to serve as a double-sided clamp which permits clamping a work piece to one of the clamps and using the clamp on the other side to attach the double-sided clamp to a fixed base or bench.

The apparatus includes an elongated base with a straight longitudinally running surface that can operate as a straight edge. The base includes a hollow channel through which a solid rod is suspended. A fixed clamp surface perpendicular to the rod is attached to one end of the elongated base. A moveable lock and clamp structure is mounted in the hollow channel so as to be longitudinally moveable along the rod. The lock and clamp structure includes a moveable clamp surface facing the fixed clamp surface. The lock on the moveable clamp structure can engage the solid rod to prevent the lock and clamp structure from moving in a direction away from the fixed clamp surface.

The lock of the invention includes a plurality of lock plates, each with a hole therethrough. The lock plates are mounted with the solid rod through their holes. A spring surrounding the rod and inserted within the lock and clamp housing pushes against the lock plates. A handle is rotatably mounted on the lock and clamp housing. The handle includes a narrow portion against which the lock plates lean in a sufficiently perpendicular position to the rod so that the housing can be moved longitudinally back and forth along the rod. The handle includes a cam portion which, when the handle is rotated into the locked position, causes the lock plates to tilt with respect to the rod, thereby preventing the lock and clamp housing from moving in a direction away from the fixed clamp surface. As the handle is rotated from the open position to the locked position, the housing is urged in a direction towards the fixed clamp structure to better secure the workpiece between the two clamp surfaces.

The elongated base has a flat bottom surface. Screw holes in the bottom surface may be used to mount the clamp on a flat surface. Moreover, the clamp may be mounted to the back of another identical clamp. Thus a double-sided clamp can be formed with two flat bottomed clamps of the present invention. The lock and clamp housing in the clamp of the present invention can be moved along the base with one hand that can also be used to operate the lock. Thus, the slide bar clamp of the present invention allows for simple one-handed operation of the lock and clamp. Other objects and advantages of the present invention will become apparent during the following description of the presently preferred embodiments of the invention taken in conjunction with the drawings.

DETAILED DESCRIPTION OF THE PREFERRED EMBODIMENT

Figure 1:
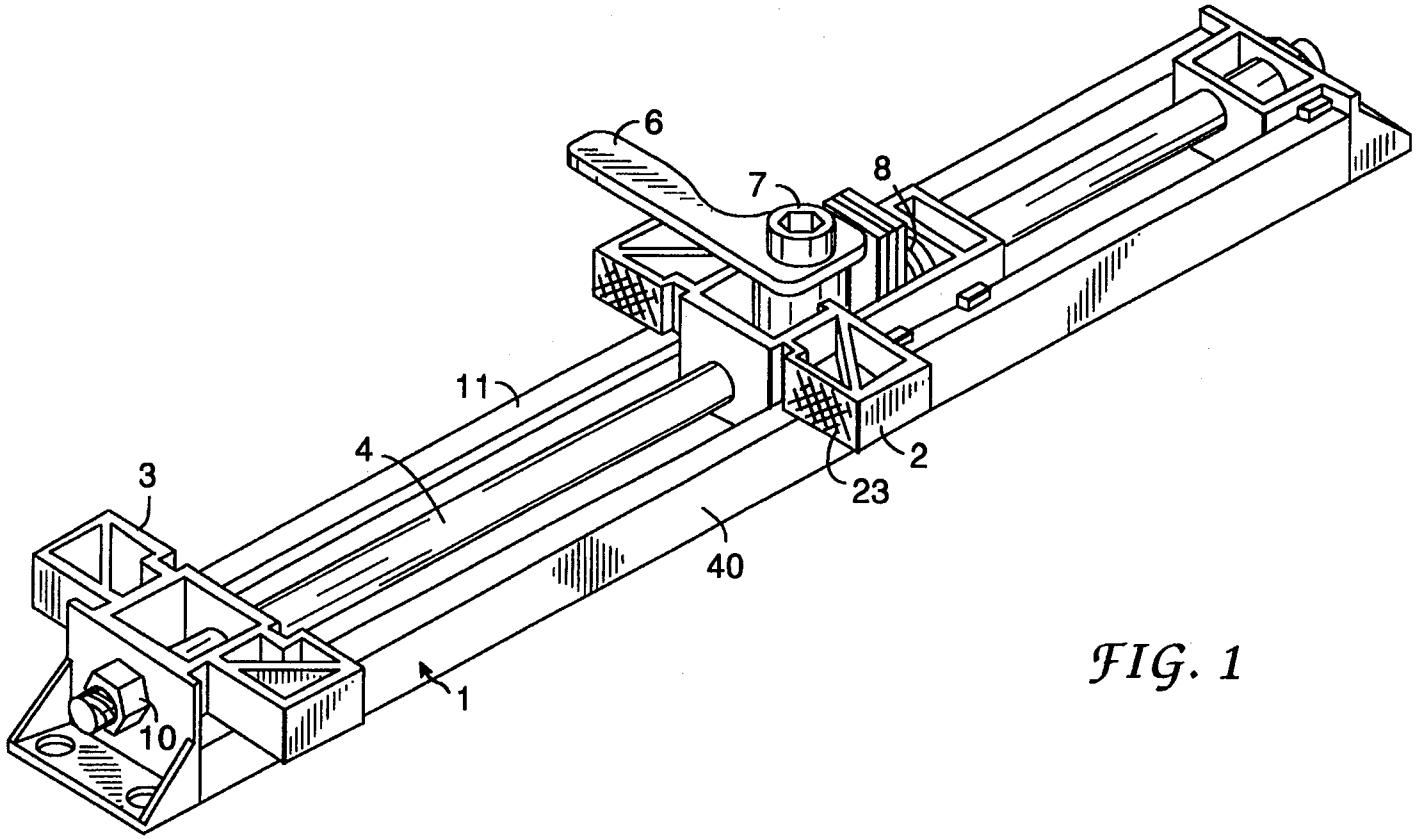
FIG. 1 is a perspective view of the slide bar clamp and straight edge of the present invention.

The slide bar clamp and straight edge of the present invention shall now be described in greater detail with reference to the drawings. The clamp is formed on an elongated base 1. An elongated hollow channel is formed in the top of the base 1. A bottom surface of the base 1 is flat. Extending up from the two opposed longitudinal edges of the bottom flat surface are straight surfaces 40. The straight surfaces 40 may serve as a straight edge. An overhang 11 extends inward from each of the straight surfaces 40 to provide a track over the hollow channel on the top of the base. The moveable lock and clamp structure 2 is mounted on the channel. The moveable lock and clamp structure includes a clamp surface 23 which faces toward a fixed clamp surface 3 attached to an end of the base 1. A rod 4 is suspended within the channel of the base. The moveable lock and clamp structure 2 is mounted on the rod 4 for longitudinal movement back and forth along the channel. A lock handle 6 is rotatably mounted on the lock and clamp housing. The lock handle 6 is secured at its pivot point by a pivot screw 7. The handle 6 can be moved between an open position in which the lock and clamp housing can be moved freely back and forth along the rod 4 and a locked position in which the lock and clamp housing is prevented from moving in a direction away from the fixed clamp surface 3. In the locked position, a workpiece can be held securely in position between the fixed clamp surface 3 and the moveable clamp surface 23.

Figure 2:
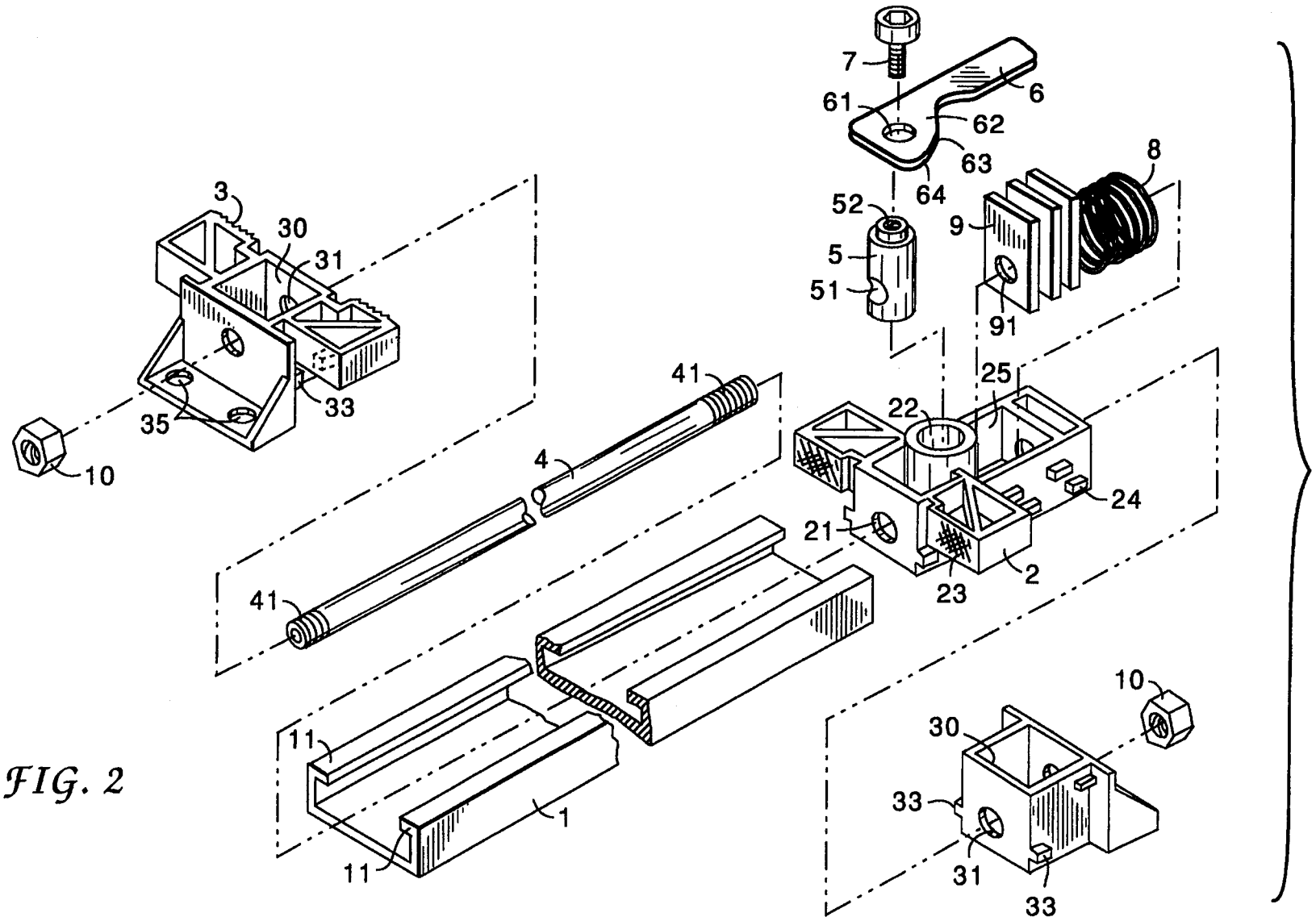
FIG. 2 is an exploded view of the clamp and straight edge of FIG. 1.

A more detailed understanding of the slide bar clamp of the present invention may be had with further reference to FIG. 2. At each opposite end of the channel in the base 1 there is mounted an endplate 30. Each endplate 30 includes an endwall with a hole 31 therein through which the rod 4 is inserted. The rod 4 is provided with a thread 41 at each end thereof. A nut 10 may be used at each end of the rod 4 to hold the apparatus together. The endplates are designed so as to fit within an end of the channel. By securely attaching a nut 10 to both ends of the rod 4, both endwalls are held securely against the base 1 to complete the clamp apparatus. The endplates are each provided with nubs 33 which snugly fit beneath the overhang 11 in the base 1. The nubs 33 prevent the endplates from sliding off the channel while the rod 4 and nut 10 hold the endplates against the ends of the base 1.

Each of the endplates 30 is provided with a bottom surface which aligns flush with the bottom surface of the base 1. Thus, the bottom surface of the endplates forms an extension of the base 1. Each of the bottom surfaces of the endplates is provided with two screw holes 35. The screw holes 35 may also be used to attach the clamp to an adjacent flat surface, such as a bench or wood block. The screw holes 35 may be used as described later with respect to FIG. 5 to attach a second clamp to the first clamp, thereby forming a double-sided clamp.

The fixed clamp surface 3 is formed as an integral part of one of the endplates 30. The fixed clamp surface is oriented perpendicular to the rod 4 and the straight surface 40. The moveable clamp surface 23 on the movable lock and clamp structure faces the fixed clamp surface 3. The moveable lock and clamp structure is formed in a housing 2. A plurality of lock plates 9 are inserted within the housing. Each lock plate 9 includes a hole 91 through which the rod 4 is inserted. The lock plates 9 are arranged face-to-face one against the other within the housing. A spring 8 also mounted about the rod 4 is inserted between a housing wall and the lock plates 9. The spring 8 urges the lock plates in the direction towards the fixed clamp surface 3. The holes 91 in the lock plates 9 are in the lower portion of the lock plates. Against the upper portion of the lock plates 9 is the handle 6. The handle 6 rotates about a pivot 52. A screw 7 attaches the handle 6 to the pivot 52. The screw 7 may be removed to allow the handle 6 to be flipped over to switch the handle between left and right handed operation. The screw 7 is then replaced to secure the handle on the pivot 52. Pivot 52 is located atop a stump 5. The stump 5 has a hole 51 therethrough through which the rod 4 extends. The stump 5 fits down into a well 22 in the housing 2 of the lock and clamp structure. The housing 2 includes a hole 21 therethrough for insertion of the rod 4. The housing 2 is provided with nubs 24 above and below the overhang 11. Thus, the housing can slide back and forth along the channel with the nubs 24 holding the housing on track within the overhangs 11.

Figure 3:
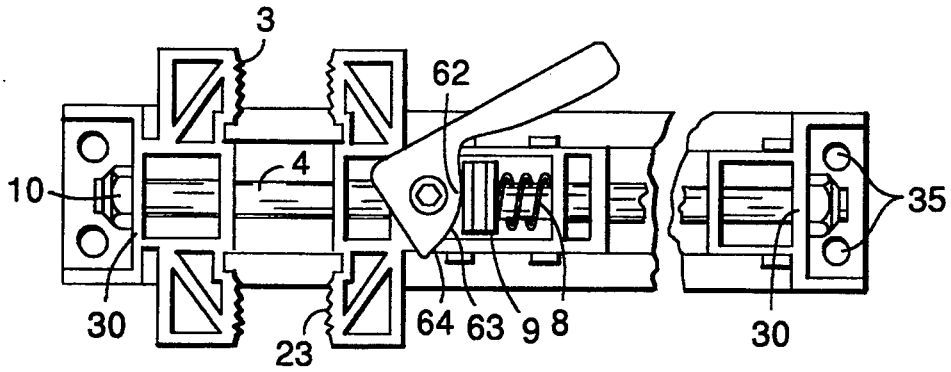
FIG. 3 is a plan view of the clamp and straight edge of FIG. 1 with the lock structure in the open position.
Figure 4:
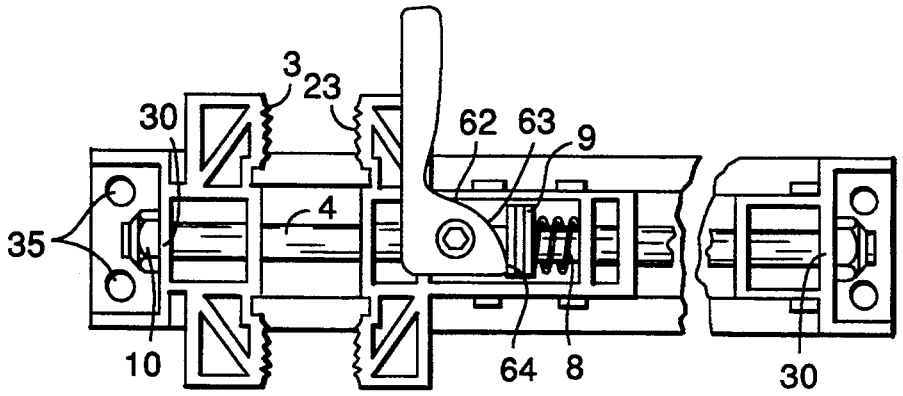
FIG. 4 is a plan view of the clamp and straight edge of FIG. 1 with the lock structure in the locked position.

The handle 6 assumes two basic positions. In FIG. 3, the open position is shown. A narrowed portion 62 of the handle is narrowed in that there is a relatively small distance between the pivot 52 and the edge of the handle. In the open position, the lock plates 9 lean against the narrowed portion 62 of the handle. The spring 8 pushes the lock plates 9 against the narrowed portion. In this position, the lock plates 9 are sufficiently perpendicular to the rod 4 such that the lock and clamp structure can be freely moved back and forth through the channel along the rod 4. As the handle 6 is moved from the open position of FIG. 3 into the locked position shown in FIG. 4, a transition portion 63 of the handle slides against the lock plates 9. The transition portion gradually increases the distance between the pivot point 52 and the edge of the handle pushing against the lock plates 9. This causes the lock plates to tilt such that the edges of the holes 91 of the lock plates grab against the rod 4 such that the lock plates cannot be moved in the direction away from the fixed jaw surface 3. As the distance between the pivot point 52 and the edge of the handle 6 continues to increase, the housing 2 of the clamp and lock structure is moved towards the fixed jaw clamp surface 3. The clamp surfaces are thus forced together, more securely holding a workpiece between them. In the final locked position shown in FIG. 4, the cam portion 64 of the handle is leaning against the lock plates 9. The lock plates are thus tilted with respect to the rod 4. In this position the inner edges of the holes 91 in the lock plates prevent movement of the lock and clamp structure 2 in a direction away from the fixed clamp surface 3.

In accordance with the present invention, it is a simple matter to move the lock and clamp structure with one hand into the desired position with respect to a workpiece and then use a finger to engage the locking handle. Thus, locking a workpiece to the slide bar clamp can be a simple one-handed operation. With the slide bar clamp attached to a workpiece, the straight surfaces 40 can be used as a straight edge. The clamp holds the edges securely in position. Other operations such as drilling, routing, sawing or sanding may then be performed using the secured straight edge surface 40 as a guide. For example, a router may be operated along the straight edge to rout an area delineated by the straight edge. The straight edge is advantageously held firmly in position on the workpiece by the clamp surfaces of the slide bar clamp and straight edge. Additional clamp are not required.

The details of the materials used in the presently preferred embodiment shall now be described. The presently preferred base 1 is formed from extruded aluminum. The rod 4 is a heat-treated steel rod. The endplates 30 and the housing 2 are all formed from molded nylon. The clamp surfaces may be provided with an array of teeth to provide additional gripping power. The spring 8 is formed from music wire. The lock plates 9 are formed from heat-treated steel. These materials are merely those of the presently preferred embodiment. Any number of other materials may be substituted which can equally perform the functions of the present invention.

Figure 5:
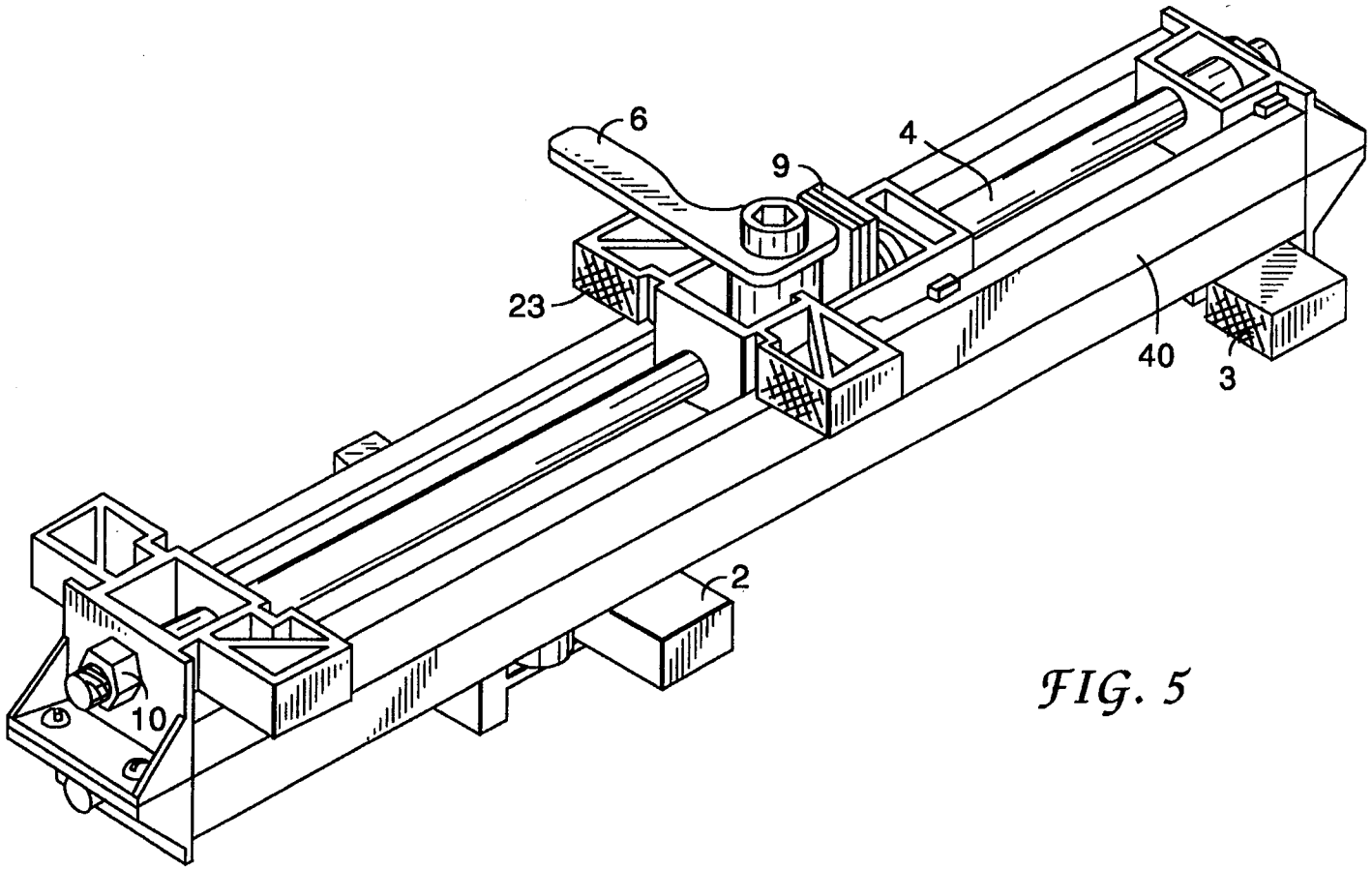
FIG. 5 is a perspective view of two slide bar clamps of the present invention mounted back-to-back to form a double-sided clamp.

Referring now to FIG. 5, the slide bar clamp of the present invention is shown in a back-to-back configuration so as to form a double-sided clamp. The double-sided clamp is formed by attaching two of the slide bar clamps of FIG. 1 together with their bottom faces adjacent one another. The screw holes 35 in the endplates of each of the slide bar clamps are used to fasten the two clamps together with nuts and bolts. The resulting double-sided clamp has four clamping surfaces. Each side has a fixed clamp surface and a moveable lock and clamp structure. While one side of the clamp may be used to attach the double-sided clamp to a saw horse, for instance, the other side of the clamp may be used to attach the workpiece.

Of course, it should be understood that various changes and modifications to the preferred embodiments described above will be apparent to those skilled in the art. For example, alternative clamping mechanisms may be used on the lock and clamp structure of the slide bar clamp and straight edge. Also, the double-sided clamp may be made an integral structure rather than through the attachment of two individual slide bar clamps. These and other changes can be made without departing from the spirit and scope of the invention and without diminishing its attendant advantages. It is therefore intended that such changes and modifications be covered by the following claims.

We claim:

1. A mountable straight edge comprising:

a base having a channel and a straight surface running longitudinally along and adjacent to the channel;

a rod fixed within the channel;

a first clamp surface, perpendicular to the straight surface, fixedly mounted to said base; and a movable lock and clamp structure, mounted within the channel so as to be longitudinally movable along said rod, including a second clamp surface facing said first clamp surface and a lock having a locked position in which said rod is engaged by said lock to prevent said lock and clamp structure from moving in a direction away from said first clamp surface wherein the lock comprises a housing, a plurality of lock plates arranged face to face and located within the housing with each lock plate having a hole through which said of extends and a handle rotatably mounted to a pivot point on the housing, the handle having a narrowed portion relative to the pivot point and a transition portion that increasingly widens into a cam portion, said movable lock and clamp structure being freely movable along said rod when the handle is in an unlocked position with the lock plates leaning on the narrowed portion and said lock and clamp structure being prevented from moving in a direction away from said first clamp surface as the handle is rotated to engage the lock plates with the transition portion and then the cam portion and wherein movement of the handle from the unlocked position to the locked position pushes the second clamp surface toward said first clamp surface.

2. A flat bottomed clamp comprising:

an elongated base having a flat bottom surface and a hollow longitudinal channel on top;

a rod suspended within the channel and oriented longitudinally therein;

a first clamp surface fixed on said base perpendicular to said rod;

a movable lock and clamp structure, mounted within the channel so as to be longitudinally movable along said rod, including a second clamp surface facing said first clamp surface and a lock which can engage said rod to prevent said lock and clamp structure from moving in a direction away from said first clamp surface wherein the lock comprises a housing, a plurality of lock plates arranged face to face located within the housing with each lock plate having a hole through which said rod extends and a handle rotatably mounted to a pivot point on the housing, the handle having a narrowed portion relative to the pivot point and a transition portion that increasingly widens into a cam portion, said movable lock and clamp structure being freely movable along said rod when the handle is oriented with the lock plates leaning on the narrowed portion and said lock and clamp structure being prevented from moving in a direction away from said first clamp surface as the handle is rotated to engage the lock plates with the transition portion and then the cam portion; and means for mounting the flat bottom surface of said clamp to an adjacent flat surface.

3. The flat bottomed clamp of claim 2 wherein the adjacent flat surface comprises a flat bottom surface of a second flat bottomed clamp.

4. A flat bottomed clamp of claim 3 wherein said means for mounting comprises screw holes in the flat bottom surface.

5. A slide bar clamp comprising:

a rod;

a first clamp surface affixed perpendicular to said rod;

a housing mounted to said rod so as to be movable along said rod, said housing having a second clamp surface facing said first clamp surface;

a plurality of lock plates arranged face to face within said housing and each of said lock plates having a hole through which said rod extends;

a spring mounted on said rod between a wall of said housing and said plurality of lock plates to apply force on said lock plates in a direction toward said first clamp surface; and a handle rotatably mounted to a pivot point on the housing, the handle having a narrowed portion relative to the pivot point and a transition portion that increasingly widens into a cam portion, said movable lock and clamp structure being freely movable along said rod when the handle is and said lock and clamp structure being prevented from moving in a direction away from said first clamp surface as the handle is rotated to engage the lock plates with the transition portion and then the cam portion.

6. The slide bar clamp of claim 5 further comprising an elongated base having a longitudinal channel and wherein said rod is suspended within the channel.

7. The slide bar clamp of claim 6 further comprising a flat surface along a bottom side of said base opposite the channel and screw holes in the flat surface for mounting said bar clamp on an adjacent surface.

8. The slide bar clamp of claim 5 wherein rotation of said handle from an open position with the lock plates leaning against the narrowed portion to a closed position with the lock plates leaning against the cam portion pushes the second clamp surface toward said first clamp surface.

9. A slide bar clamp comprising:

an elongated base having a flat bottom surface, two ends, two straight surfaces extending from opposite edges of the bottom surface perpendicular to the bottom surface and a hollow channel between the straight surfaces;

a rod suspended longitudinally within the channel;

a first clamp surface fixedly mounted on top of said base perpendicular to said rod;

a housing mounted to said rod so as to be movable along said rod, said housing having a second clamp surface facing said first clamp surface;

a plurality of lock plates arranged face to face within said housing and each of said lock plates having a hole through which said rod extends;

a spring mounted on said rod between a wall of said housing and said plurality of lock plates to apply force on said lock plates in a direction toward said first clamp surface; and a handle rotatably mounted to a pivot point on said housing and having a narrowed portion relative to a pivot point and a transition portion that increasingly widens into a cam portion, said movable lock and clamp structure being freely movable along said rod when the handle is oriented with the lock plates leaning on the narrowed portion and said lock and clamp structure being prevented from moving in a direction away from said first clamp surface as the handle is rotated to engage the lock plates with the transition portion and then the cam portion.

10. The slide bar clamp of claim 9 further comprising an endplate affixed to each end of said base flush with the bottom surface, each endplate having screw holes therein for mounting said bar clamp to an adjacent surface.

11. The slide bar clamp of claim 10 wherein the adjacent surface comprises a flat bottom surface of a second slide bar clamp.

12. The slide bar clamp of claim 10 further comprising an endwall connected to each of said endplates and wherein said rod is secured between said endwalls so as to be suspended within the channel.

13. The slide bar clamp of claim 5 wherein rotation of said handle from an open position with the lock plates leaning against the narrowed portion to a closed position with the lock plates leaning against the cam portion pushes the second clamp surface toward said first clamp surface.

14. A double sided clamp comprising:

an elongated base having a top side and a bottom side;

a first rod mounted over the top side of said base perpendicular to said first clamp surface and parallel to said elongated base;

a first movable lock and clamp structure, mounted on said first rod so as to be longitudinally movable along said first rod, including a second clamp surface facing said first clamp surface and a first lock which can be engaged to prevent said movable lock and clamp structure from moving in a direction away from said first clamp surface;

a third clamp surface fixed on the bottom side of said base;

a second rod mounted beneath the bottom side of said base perpendicular to said third clamp surface and parallel to said elongated base; and a second movable lock and clamp structure independent of said first movable lock and clamp structure, mounted on the bottom side of said base so as to be longitudinally movable along said base, including a fourth clamp surface facing said second clamp surface and a second lock which can be engaged to prevent said second movable lock and clamp structure from moving in a direction away from said third clamp surface.

15. The double sided clamp of claim 14 further comprising a first hollow channel in the top side of said elongated base and a second hollow channel in the bottom side of said elongated base and a first rod suspended within said first hollow channel and oriented longitudinally therein and a second rod suspended within said second hollow channel and oriented longitudinally therein, said first movable lock and clamp structure and said second movable lock and clamp structure being mounted on said first and second rods, respectively, so as to be movable longitudinally back and forth thereon.

16. The double sided clamp of claim 15 wherein the first and second locks each comprise a housing, a plurality of lock plates located within the housing and each lock plate having a hole through which said respective rod extends with the lock plates arranged face to face, a spring mounted on said respective rod between the housing and the lock plates and a handle rotatably mounted to a pivot point on the housing, the handle having a narrowed portion relative to the pivot point and a transition portion that increasingly widens into a cam portion, said movable lock and clamp structure being freely movable along said rod when the handle is oriented with the lock plates leaning on the narrowed portion and said lock and clamp structure being prevented from moving in a direction away from said first clamp surface as the handle is rotated to engage the lock plates with the transition portion and then the cam portion.

17. The mountable straight edge of claim 1 further comprising a spring mounted on said lock between the housing and the lock plates, said spring urging the lock plates in a direction toward said first clamp surface.

18. The flat-bottomed clamp of claim 12 further comprising a spring mounted on said lock between the housing and the lock plates, said spring urging the lock plates in a direction toward said first clamp surface.

* * * * *

UNITED STATES PATENT AND TRADEMARK OFFICE

CERTIFICATE OF CORRECTION

PATENT NO. : 5,348,276

DATED : September 20, 1994

INVENTOR(S) : Paul N. Blacker

It is certified that error appears in the above-indentified patent and that said Letters Patent is hereby corrected as shown below:

| | |
|---|---|
| Column 5, line 16, | "of" should be --rod-- |
| Column 6, line 1, | "A" should be --The-- |
| line 1, | "3" should be --2-- |
| line 22, | "when the handle is and said lock" should be --when the handle is oriented with the lock plates leaning on the narrowed portion and said lock-- |
| Column 7, line 24, | omitted line before the words "a first rod" should be --a first clamp surface fixed on the top side of said base;-- |
| Column 8, line 39, | "12" should be --2-- |

Signed and Sealed this

Thirty-first Day of January, 1995

Bruce Lehman

*Attest:*

BRUCE LEHMAN

*Attesting Officer*

*Commissioner of Patents and Trademarks*